US012789066B2

(12) United States Patent
Simmons, Jr.

(10) Patent No.: US 12,789,066 B2
(45) Date of Patent: Nov. 10, 2026

(54) SENSOR-OPERATED BASKETBALL TRAINING SYSTEM

(71) Applicant: Clinton Simmons, Jr., Woodbridge, VA (US)

(72) Inventor: Clinton Simmons, Jr., Woodbridge, VA (US)

( * ) Notice: Subject to any disclaimer, the term of this patent is extended or adjusted under 35 U.S.C. 154(b) by 313 days.

(21) Appl. No.: 17/475,879

(22) Filed: Sep. 15, 2021

(65) Prior Publication Data

US 2023/0084889 A1 Mar. 16, 2023

(51) Int. Cl.
*A63B 69/00* (2006.01)
*A63B 71/06* (2006.01)

(52) U.S. Cl.
CPC ..... *A63B 69/0071* (2013.01); *A63B 71/0622* (2013.01); *A63B 71/0686* (2013.01); *A63B 2071/0683* (2013.01); *A63B 2214/00* (2020.08); *A63B 2220/17* (2013.01); *A63B 2220/833* (2013.01); *A63B 2225/50* (2013.01)

(58) Field of Classification Search
CPC ..... A63B 69/0071; A63B 2243/0037; A63B 2071/0625; A63B 2220/17; A63B 2220/833; A63B 2024/0078; A63B 2225/50; A63B 2024/0025; A63B 71/00622; A63B 71/0686; A63B 2214/00; A63B 2071/0683
See application file for complete search history.

(56) References Cited

U.S. PATENT DOCUMENTS 1,929,273 A * 10/1933 Crago ..... E05F 15/74 250/221
2,299,798 A * 10/1942 Colson ..... A63B 71/06 250/221

(Continued)

FOREIGN PATENT DOCUMENTS

CN 203556124 U * 4/2014
CN 111111136 A * 5/2020

(Continued)

OTHER PUBLICATIONS

DE 202013101292 U1 (Year: 2013).*

(Continued)

*Primary Examiner* — John E Simms, Jr.
*Assistant Examiner* — Amir A Klayman
(74) *Attorney, Agent, or Firm* — Deidre McAuley

(57) ABSTRACT

Provided is a sensor-operated basketball training system that includes a base unit and a satellite unit both providing upright support to the system on a flat surface, each of the base unit and the satellite unit having a leg portion adjustable in a vertical direction to correspond to a height of a user and the satellite unit includes a satellite sensor for emitting a signal(s) and the base unit having a base sensor for receiving signals from the satellite sensor, a retractable drawstring to be extended to connect to the satellite unit in parallel with the signal(s) transmitted to the base unit from the satellite unit, a timer to track time, and a digital counter which counts a total number of times the user performs a basketball (Continued)

operation (e.g., a dribbling operation) and interferes with or blocks the signal transmitted to the base unit during a time period tracked.

5 Claims, 6 Drawing Sheets

(56) References Cited

U.S. PATENT DOCUMENTS 4,074,117 A * 2/1978 DeLorean ..... G07C 1/22 340/928
4,186,388 A * 1/1980 Robinson ..... F16M 11/34 250/221
4,461,477 A * 7/1984 Stewart ..... A63B 69/0002 473/409
4,563,005 A * 1/1986 Hand ..... A63B 63/00 434/247
4,752,764 A * 6/1988 Peterson ..... G07C 1/24 340/309.7
4,834,375 A * 5/1989 Elstein ..... A63B 24/00 473/417
4,932,137 A * 6/1990 Haley ..... A63B 5/16 482/901
5,005,828 A * 4/1991 Sauerbrey ..... A63B 5/02 482/17
5,081,896 A * 1/1992 Hiyoshi ..... G10H 1/00 250/221
5,087,047 A * 2/1992 McConnell ..... A63B 69/36 250/221
5,120,228 A * 6/1992 Stahl ..... A61B 5/1038 600/595
5,266,810 A * 11/1993 Murphy ..... G01V 8/20 250/559.24
5,271,627 A * 12/1993 Russell ..... A63B 69/0053 482/84
5,436,611 A * 7/1995 Arlinghaus, Jr. ..... G07C 1/24 368/2
5,520,595 A * 5/1996 Lee ..... A63B 5/16 250/221
5,897,457 A * 4/1999 Mackovjak ..... A63B 24/00 482/3
6,628,265 B2 * 9/2003 Hwang ..... G10H 1/34 250/221
6,715,448 B1 * 4/2004 McComb ..... A63K 3/046 119/705
6,907,840 B1 * 6/2005 Gaines ..... A63B 71/0605 116/222
7,309,234 B2 * 12/2007 Mathog ..... A63B 69/0053 434/258
7,367,906 B2 * 5/2008 Tien ..... A63B 69/0002 473/422
7,508,739 B2 * 3/2009 Paes ..... G04F 8/08 368/2
7,858,870 B2 * 12/2010 Riopelle ..... G06F 3/011 84/625
7,951,045 B1 * 5/2011 Brader ..... A63B 71/06 482/3
8,070,654 B2 * 12/2011 Chapa, Jr. ..... A63B 24/0006 482/8
8,823,549 B1 * 9/2014 Moone ..... G08G 1/01 116/63 P
9,248,358 B2 * 2/2016 Tinjust ..... A63B 71/0622
9,375,627 B2 * 6/2016 Hansen ..... G07C 1/24
9,566,489 B2 * 2/2017 De Graaf ..... A63B 69/00
9,645,279 B2 * 5/2017 Weiner ..... G01V 8/10
9,886,624 B1 * 2/2018 Marty ..... G06V 40/23
10,058,724 B2 * 8/2018 Duncan ..... A63B 71/0669
10,363,475 B2 * 7/2019 Chapa, Jr. ..... A63B 71/03
10,500,465 B1 * 12/2019 Panaia ..... A63B 71/023
11,298,602 B2 * 4/2022 Lloyd ..... A63B 69/0071
12,005,334 B1 * 6/2024 Cochran ..... A63B 69/0071
2004/0005939 A1 * 1/2004 Bourguet ..... A63B 69/0084 473/447
2009/0170640 A1 * 7/2009 Thompson ..... A63B 69/38 434/258
2011/0207561 A1 * 8/2011 Adams ..... A63B 71/0686 473/447
2015/0165294 A1 * 6/2015 Wackerly ..... G09B 19/0038 473/448
2016/0193518 A1 * 7/2016 Baxter ..... A63B 71/0669 473/483
2016/0367847 A1 * 12/2016 Antunes ..... A63B 69/0028
2017/0113096 A1 * 4/2017 Yu ..... G06F 3/067
2017/0296894 A1 * 10/2017 Min ..... A63B 71/0622
2018/0154234 A1 * 6/2018 Pack ..... A63B 63/083
2019/0374843 A1 * 12/2019 Elder ..... A63B 69/002

FOREIGN PATENT DOCUMENTS

DE 202013101292 U1 * 7/2013 ..... A63B 5/16
EP 0769310 A1 * 4/1997
EP 4122562 A1 * 1/2023 ..... A63B 24/0021
GB 2388187 A * 11/2003 ..... A63B 5/02
JP 2006090043 A * 4/2006
LU 500461 B1 * 1/2023 ..... A63C 19/065

OTHER PUBLICATIONS

EP 0769310 A1 (Year: 1997).*
CN111111136A (Year: 2020).*
CN203556124U (Year: 2014).*
DE102009041339A1 (Year: 2011).*
EP 4122562 A1 (Year: 2023).*
JP 2006090043 A (Year: 2006).*
LU 500461 B1 (Year: 2023).*

* cited by examiner

117
Reset Switch
120
Base Sensor
121
Receiver
Base Proximity Sensor
118
134
135
Digital Counter
Timer
145
147
Notification Unit
148
116
Display
Controller/Processor
Memory
146
Power Supply
On/Off
152
150
Software Application
160
Remote Control
162
Base Unit 100
Satellite Unit 200
220
Satellite Sensor
221
Transmitter
245
Controller/Processor
246
Power Supply
On/Off

SENSOR-OPERATED BASKETBALL TRAINING SYSTEM

FIELD OF THE INVENTION

The present invention relates to a basketball training system. In particular, a sensor-operated basketball training system capable of teaching crossover dribbling of a user and able to electronically track progress of the user during use thereof.

BACKGROUND OF THE INVENTION

Basketball is a sport which requires specific training and skills. One such skill is crossover dribbling in which a basketball player dribbles a basketball within one hand and quickly switches (i.e., crosses over) the basketball to the other hand with minimal bounce in front of another player.

Current basketball training devices are typically stationary devices which are unable to be adjusted to each individual user and are unable to track the progress of a user during use.

It is therefore desirable to provide a sensor-operated basketball training system capable of easily electronically tracking a user's progress, to thereby effectively train each user to perform a crossover dribble move or other basketball skills.

SUMMARY OF THE INVENTION

According to one embodiment of the present invention, a sensor-operated basketball training system is provided. The basketball training system includes a base unit and a satellite unit both providing upright support to the system on a flat surface, each of the base unit and the satellite unit comprising a leg portion adjustable in a vertical direction to correspond to a height of a user and the satellite unit comprising a satellite sensor for emitting a signal and the base unit comprising a base sensor for receiving signals from the satellite sensor, a retractable drawstring to be extended to connected to the satellite unit in parallel with the signal(s) transmitted to the base unit from the satellite unit, and a digital counter which counts a total number of times the user performs the dribble operation and interferes with (or blocks) the signal transmitted to the base unit.

The present invention also provides a method of performing training of a crossover dribble move using the above-mentioned sensor-operated basketball training system.

Additional features and advantages are realized through the techniques of the present invention. Other embodiments and aspects of the invention are described in detail herein and are considered a part of the claimed invention. For a better understanding of the invention with the advantages and the features, refer to the description and to the drawings.

BRIEF DESCRIPTION OF THE DRAWINGS

The subject matter which is regarded as the invention is particularly pointed out and distinctly claimed in the claims at the conclusion of the specification. The forgoing and other features, and advantages of the invention are apparent from the following detailed description taken in conjunction with the accompanying drawings in which:

DETAILED DESCRIPTION OF THE INVENTION

Figure 1:
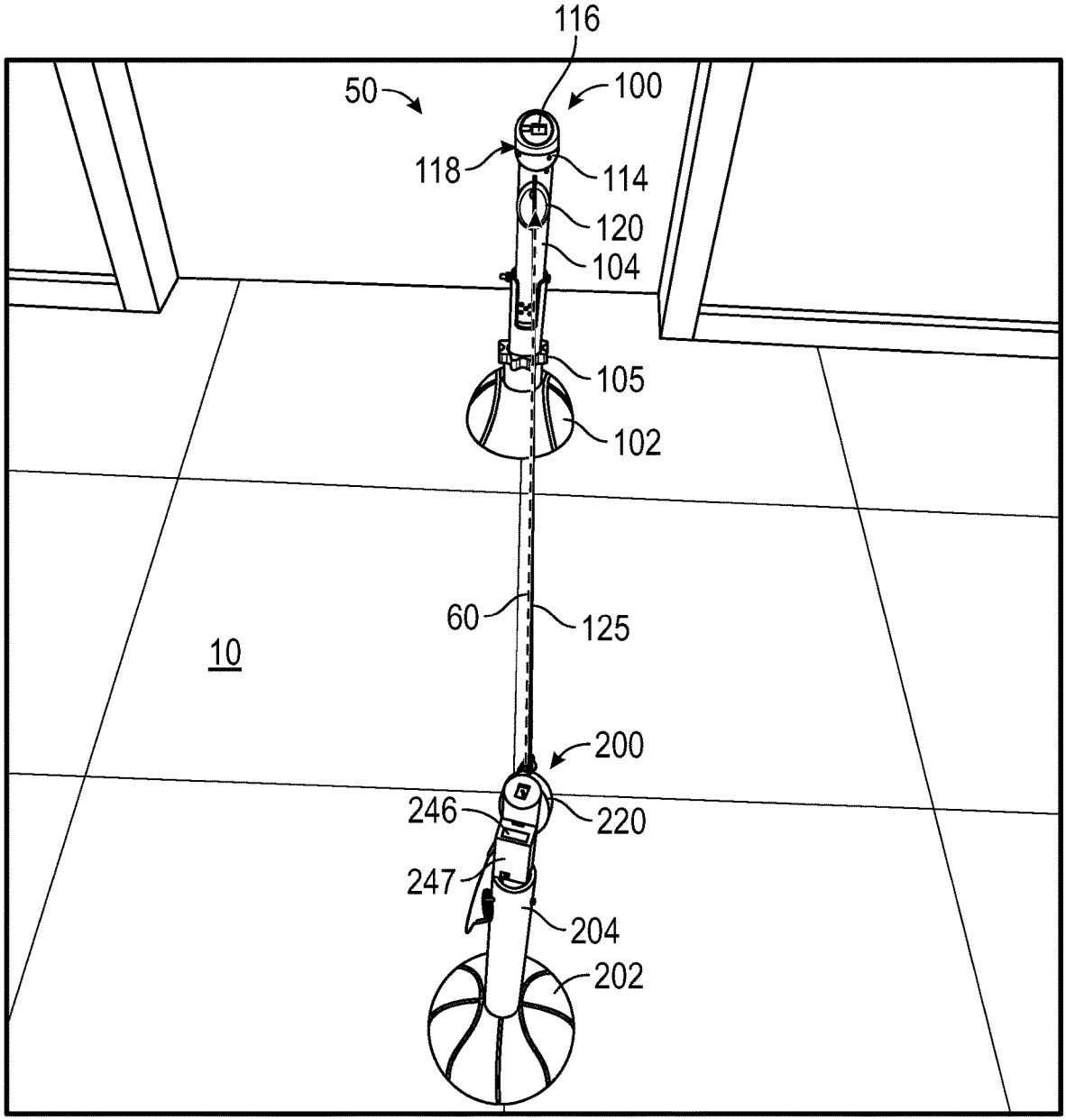
FIG. 1 is a perspective view of a sensor-operated basketball training system that can be implemented within one or more embodiments of the present invention.

The present invention describes a sensor-operated basketball training system sensing and tracking the success of a user when performing a basketball skill (e.g., a crossover dribble move), to thereby effectively train the user. One skilled in the art however will understand that the present invention may have additional embodiments and that the other embodiments of the invention may be practiced without several of the specific features described below. Although the present invention is described with use in training a player to perform a crossover dribble move, the sensor-operated basketball training system described in the present invention may also be used to effectively train other basketball skills such as "behind the back", "between the legs" and "in & out".

With reference now to FIGS. 1 through 4, a sensor-operated basketball training system 50 is provided for training a player to perform the crossover dribble move and other basketball skills as noted above.

The basketball training system 50 includes a base unit 100 and a satellite unit 200 to provide upright support to the system 50 on a flat surface (e.g., a floor 10), each of the base unit 100 and the satellite unit 200 comprising a base portion 102, 202 and a leg portion 104, 204 respectively that are adjustable in a vertical direction to correspond to a height of a user, for example, the height of the user's knees. According to an embodiment of the present invention both of the base portions 102 and 202 are weighted. They may be filled with any weighted substance, for example, sand or water, suitable for weighing down and provided fixed support of the base unit 100 and the satellite unit 200 during use. According to one or more embodiments, the base portions 102 and 202 may be formed of any size or shape that is suitable for the purposes as set forth herein. As shown in the figures, the base portions 102 and 202 are of the shape of a half of a basketball.

Figure 2:
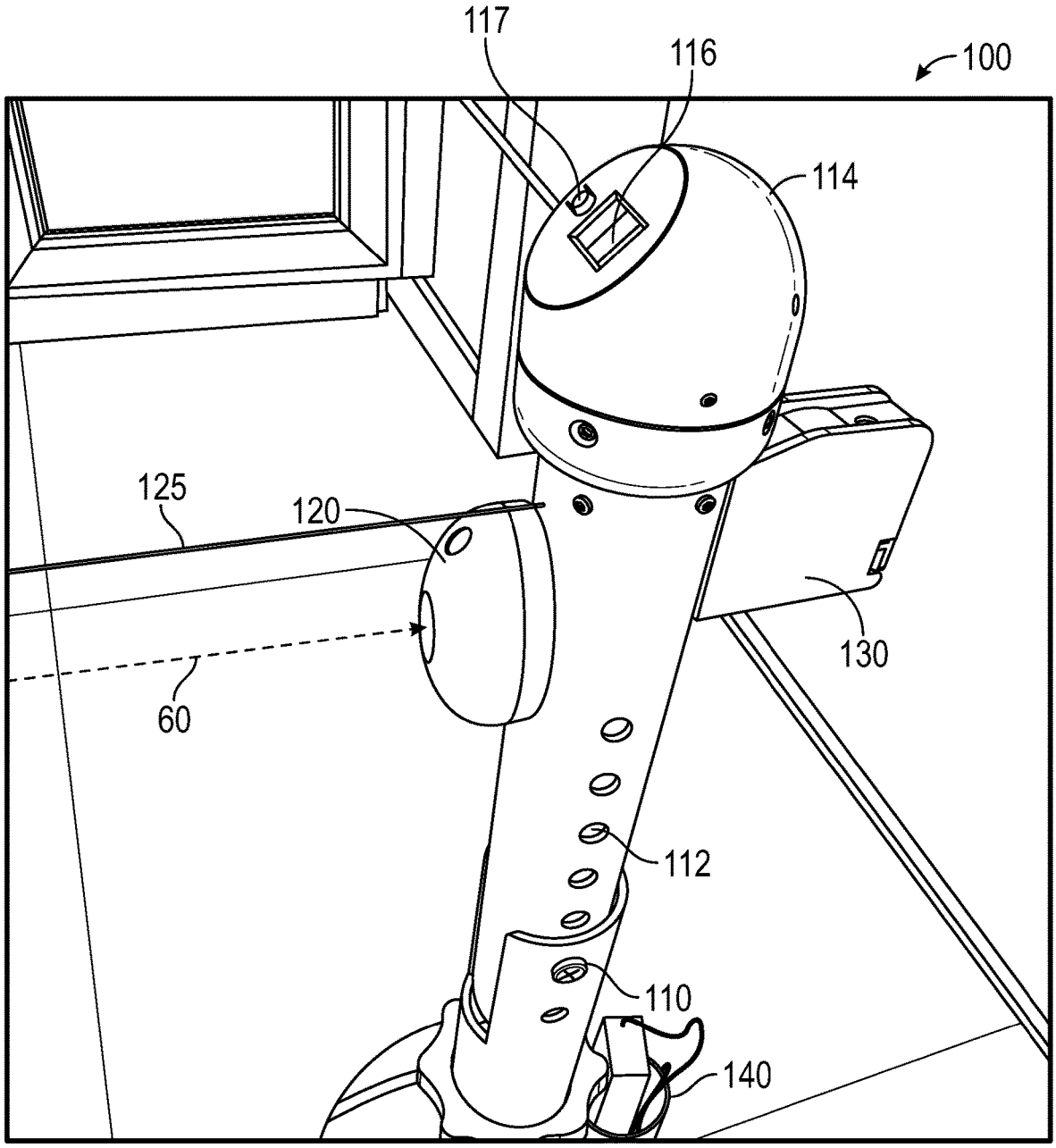
FIG. 2 is a side view of the base unit of the sensor-operated basketball training system shown in FIG. 1, according to one or more embodiments of the present invention.

Each of the base unit 100 and the satellite unit 200 have a leg portion 104 and 204 connected at a first end thereof to base portions 102 and 202 respectively and secured therewith by a securing means (e.g., securing component 105 depicted in FIG. 1). The leg portion 104 and 204 each have a removable pin 110 (as depicted in FIG. 2) at a side thereof whereby a user can raise the leg portion 104, 204 to a desired height within a maximum range of approximately 12 inches to approximately 24 inches and re-insert the pin 110 into one of the openings 112 to secure the leg portion 104, 204 at a fixed height as desired by the user. The satellite unit 200 is adjustable in a similar manner as that of the base unit 100. The present invention is not limited to any particular height and can be manufactured to be varied, as necessary.

Figure 4:
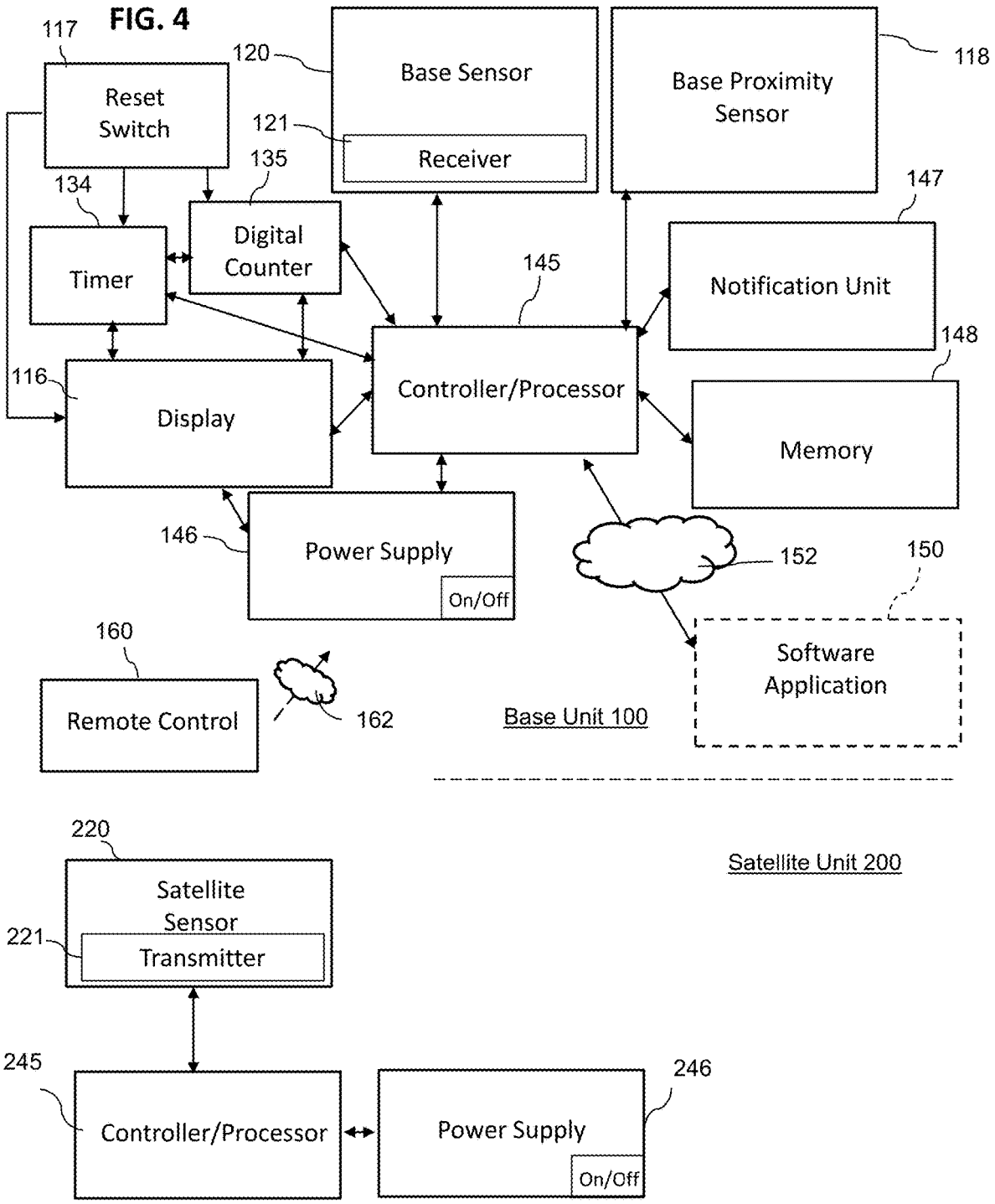
FIG. 4 is a block diagram illustrating the components of the sensor-operated basketball training system of FIG. 1, according to one or more embodiments of the present invention.

The base unit 100 further comprises a main housing 114 connected to a second end of the leg portion 104 for housing a display 116 and other components of the base unit 100 (as depicted in FIG. 4, for example) for operating the basketball system 5 and a power supply 146 including an on/off switch for supplying power to all the components of the base unit 100 as depicted in FIG. 4, to turn on the base unit 100. The base unit 100 further includes a reset switch 117 for performing a reset operation of the timer 134, digital counter 135 or display 116 (as depicted in FIG. 4) of the base unit 100.

The base unit 100 further comprises a base proximity sensor 118 for sensing that a user is within a predetermined distance of the base unit 100. The base proximity sensor 118 can be a motion sensor, a heat sensor, or any type of sensor suitable for sensing that a user is near the base unit 100. Additional detail regarding the operation of the base proximity sensor 118 and the base unit 100 will be further discussed below.

The base unit 100 further comprising a base sensor 120 for sensing and receiving a signal 60 (e.g., an infrared laser signal) from the satellite unit 200 during operation of the system 50. The base unit 100 includes a receiver 121 to receive one or more signals 60 from a transmitter 221 (as depicted in FIG. 4) of the satellite unit 200. This signal(s) 60 is continuously being transmitted during operation of the system 50.

Figure 3:
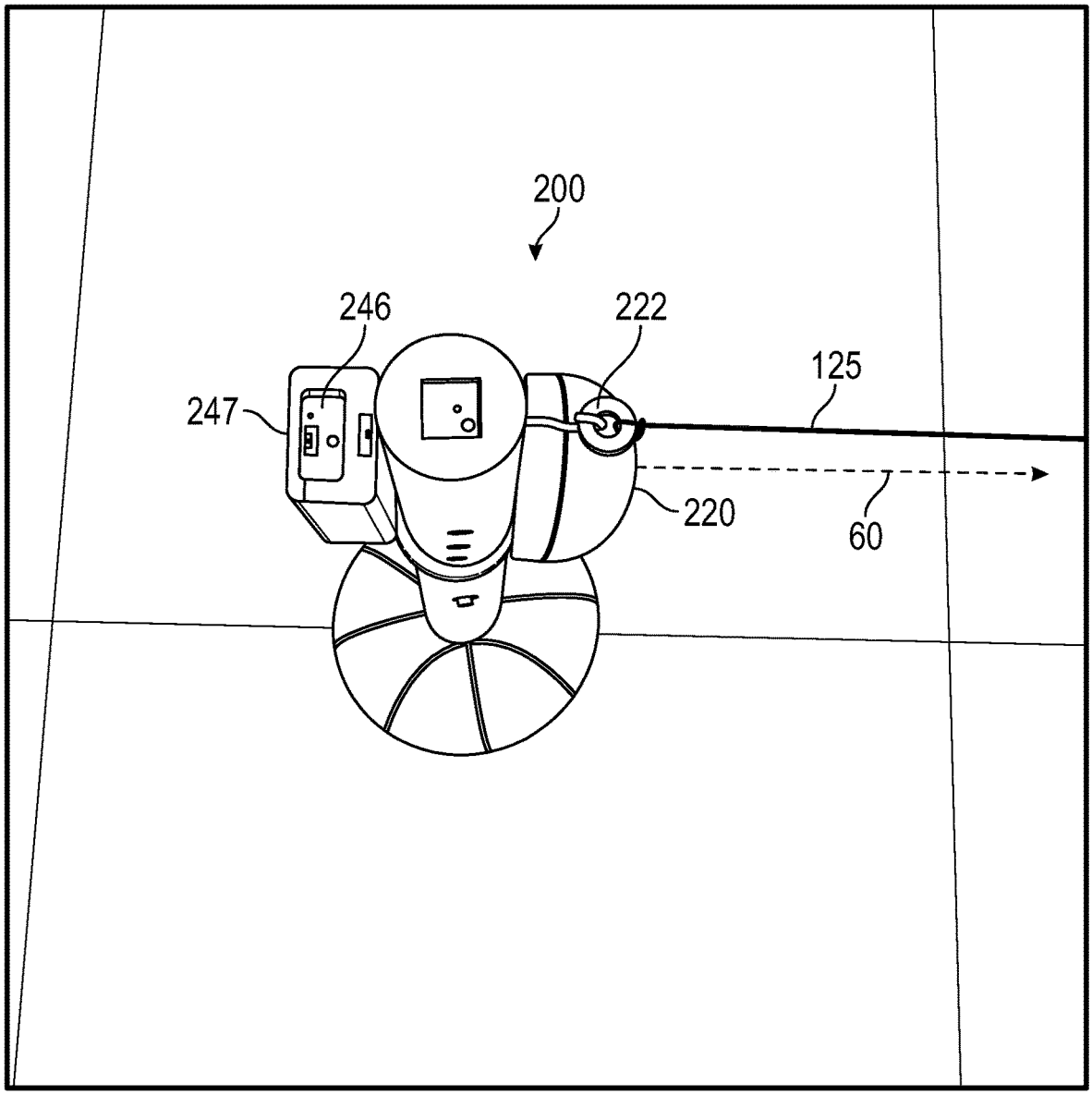
FIG. 3 is a top view of the satellite unit of the sensor-operated basketball training system according to one or more embodiments.

The base unit 100 further includes a retractable drawstring 125 retractable and extendable to connect to the satellite unit 200 during use. The base unit 100 includes a secondary housing 130 (as depicted in FIG. 2) fixedly connected to the leg portion 104 (e.g., in a back of thereof) and for retracting/storing the retractable drawstring 125, when it is not in use. The drawstring 125 extends through the leg portion 104 to a front end of the leg portion 104. According to other embodiments, the secondary housing 130 may be fixedly connected to the side or the front of the leg portion 104. The present invention is not limited to the secondary housing 130 being located in any particular location at the base portion 100. Also, alternatively according to other embodiments, the retractable drawstring 125 and the secondary housing may be located within the satellite unit 200 instead of the base unit 100. The retractable drawstring 125 is extendable in a horizontal direction in parallel (and within close proximity) with the signal(s) 60 transmitted from the satellite unit 200 to the base unit 100 and secured via a securing means 222 (e.g., a hook) (as depicted in FIG. 3) at the satellite unit 200.

The base unit 100 further comprises a timer 134 and a counter 135 (e.g., a digital counter as depicted in FIG. 4). The timer 134 tracks the time as the user is operating the system 50 while the counter 135 counts a total number of times the user performs the dribble operation over the height of the extended retractable drawstring 125 and/or interference of the signal being transmitted from the satellite unit 200 to the base unit 100 while in the system 50 is in use. The time determined by the timer 134 and the count calculated by the counter 135 are then processed via the controller/processor 145, stored in memory 148 and displayed to the user via the display 116. Any type of digital, analog electronic or other type of suitable timer or counter can be used within the present invention. The timer 134 automatically stops timing when the user is within close proximity to the base proximity sensor 118, when the system 50 has been powered down at the base unit 100, or via a remote control unit 160 (as depicted in FIGS. 4 and 6) and further discussed below.

Referring back to FIG. 2, the display 116, is configured to display status information to the user of the system 50. The status information can include the number times the basketball or the user interferes with the signal transmitted from satellite unit 200 as mentioned above, which is an indication of the user's training progress. The display 116 is not limited to provide status information and can be programmed to provide other suitable information useful to the user, as programmed, such as historical use data, current time, date information.

Figure 6:
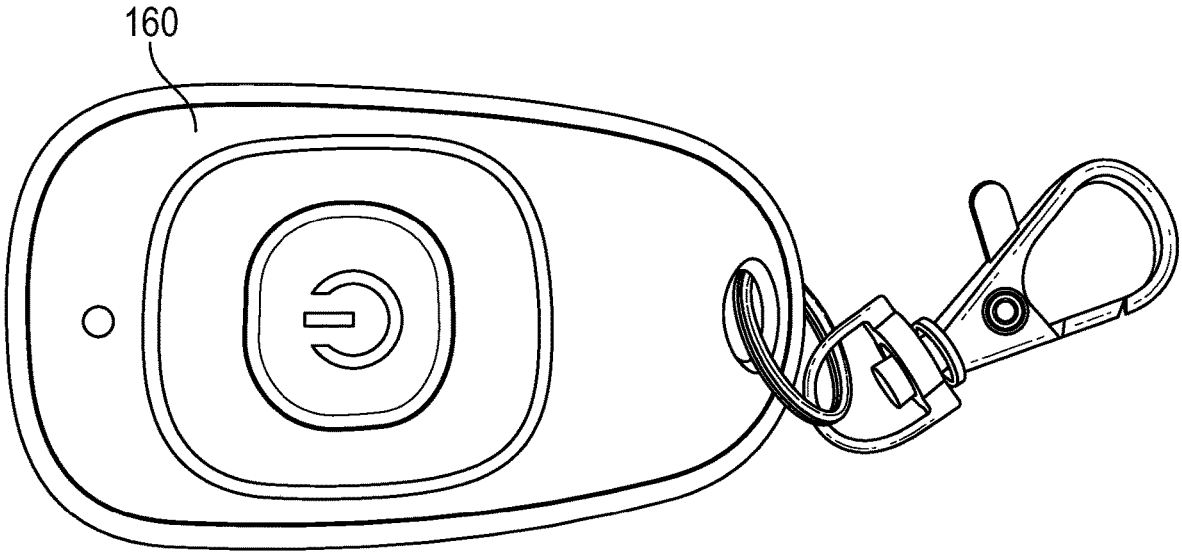
FIG. 6 is a front view of the remote control unit for resetting/restarting timing and counting operations of the sensor-operated basketball training system.

A storage holder 140 is also disposed at the base unit 100, for example, at a top of the leg portion 104 near the display 116 or at a bottom of the leg portion 104 near the base portion 102 for storing a power adapter for supplying external power to the power supply 146 and/or a remote control unit 160 (as depicted in FIG. 6) to be discussed in more detail later.

More details regarding the satellite unit 200 will now be discussed with reference to FIG. 3. According to an embodiment of the present invention, as shown in FIG. 3, the satellite unit 200 comprises some of the same components as the base unit 100 (e.g., a controller/processor 245 and a power supply 246), therefore a detailed description of these features have been omitted. For example, as mentioned above, the satellite unit 200 is adjustable in height in a similar manner as the base unit. As shown, the satellite unit 200 includes a pin 210 that can be removed to adjust the height of the leg portion 204 and then re-inserted into one of the openings 212 to secure the leg portion 204 at a fixed height as desired by the user. According to an embodiment, the height of the satellite unit 200 and the base unit 100 are required to be adjusted at the same height in order for the system 50 to operate.

The satellite unit 200 further comprises a satellite sensor 220 for emitting the signal(s) 60 (e.g., an infrared signal) to the receiver 121 of the base sensor 120 of the base unit 100 upon the start of the system 50, and a power supply 246 housed in a housing 247 connected to leg portion 204 and including an on/off switch for supply powering to the components of the satellite unit 200 including the satellite sensor 220 and a controller/processor 245 to turn on the satellite unit 200. The power supply 246 can be a replaceable or rechargeable battery or a USB interface for connecting to an external power supply source. The present invention is not limited to the base unit 100 or the satellite unit 200 being physically connected to an external power supply and can be supplied by alternative power means such as solar energy or other suitable alternative power means.

Additional details regarding the operation of the components of the system 50 will now be discussed with reference to FIG. 4. As shown in FIG. 4, the base unit 100 receives a signal via a base sensor 120 which includes a receiver for receiving the signal generated. The signal is continuously generated by the satellite unit 200 during the operation of the system 50. The base unit 100 further includes a controller/processor 145 for controlling operation of the components of the system 50 including the base proximity sensor 118, the base sensor 120 including the receiver, the display 116, the power supply 146 for supplying power to turn on the base unit 100, a memory 148 for temporarily storing the status information to be displayed to the user during use, and an optional software application 150 accessible by a user via a user system in communication with the system 50 over a network environment 152.

The controller/processor 145 can be a microcontroller, or other type of suitable control system capable of controlling operation of the components of the system 50. The controller/processor 145 can be separate components in communication to perform the control operations.

According to an embodiment, the display 116, the controller/processor 145, digital counter 135, power supply 146 and memory 148 are disposed within the main housing 114. The present invention is not limited to all of these components being disposed in a particular part of the system 50, and the location thereof can be varied as necessary.

The power supply 146 is configured to supply power to the system 50. According to one embodiment, the power supply 146 includes a universal serial bus (USB) port or interface disposed within the housing 114 to receive a cable connection (or power adapter) for connecting with an external power source (not shown). Alternatively, according to other embodiments, the power supply can be a wired, wireless or solar power supply or any other type of power supply capable of enabling operation of the system 50. The power supply 146 can also be a battery e.g., a replaceable or rechargeable battery according to one or more alternative embodiments.

A notification unit 147 is also provided which generates an audio notification signal (e.g., an alarm signal) to notify the user when the user or the basketball interferes with the signal 60 transmitted from the satellite unit 200.

The memory 148 is configured to temporarily store the status information obtained from the digital counter 135 to thereby display this information to the user of the system 50. According to other embodiments, the memory 148 can be configured to store other information such as username, password, date, historical use data (e.g., user progress information), as desired by the user. This information can be retrieved from the user of the software application 150 via a user system connected to the system 50 at the USB connector, or via an external remote user system by web access. The memory 148 can include a flash memory or other type of media or machine-readable medium suitable for storing electronic instructions for operation of the system 50. The memory 148 is in communication with an internal memory of the digital counter 135, and can be a RAM, ROM or any other type of memory suitable for the purpose set forth herein.

The software application 150 is an application enabling access to the digital counter 135 when a user system is connected with the system base unit 100 within the network environment 152. The network environment 152 can be a wired or wireless connection. The software application 150 is downloadable or installable remotely at the user system or on a cloud platform. It can be downloaded by a client or application (APP) store and implemented with the network environment 152 examples of which include Bluetooth™, Wi-Fi, or any other communication technology used within a user system. It works within a predetermined range or distance but it not limited hereto and may vary accordingly.

According to alternative embodiments, the functionality of the base unit 100 could be performed by the satellite unit 200. Thus, the components of the base unit 100 could alternatively be disposed within the satellite unit, for example, the display 116, the timer 134, counter 135, notification unit 147 and the memory 148, Therefore, the user would be able to view the status and use information of the system 50 at the satellite unit 200 instead of the base unit 100.

Further as shown in FIG. 4, the satellite unit 200 includes the satellite sensor 220, a controller/processor 245, and the power supply 246 supplying power to the components of the satellite unit 200. When the power supply 246 is turned on via a switch thereto, the controller/processor 245 sends a signal to the satellite sensor 220 to generate the signal(s) 60

Figure 5:
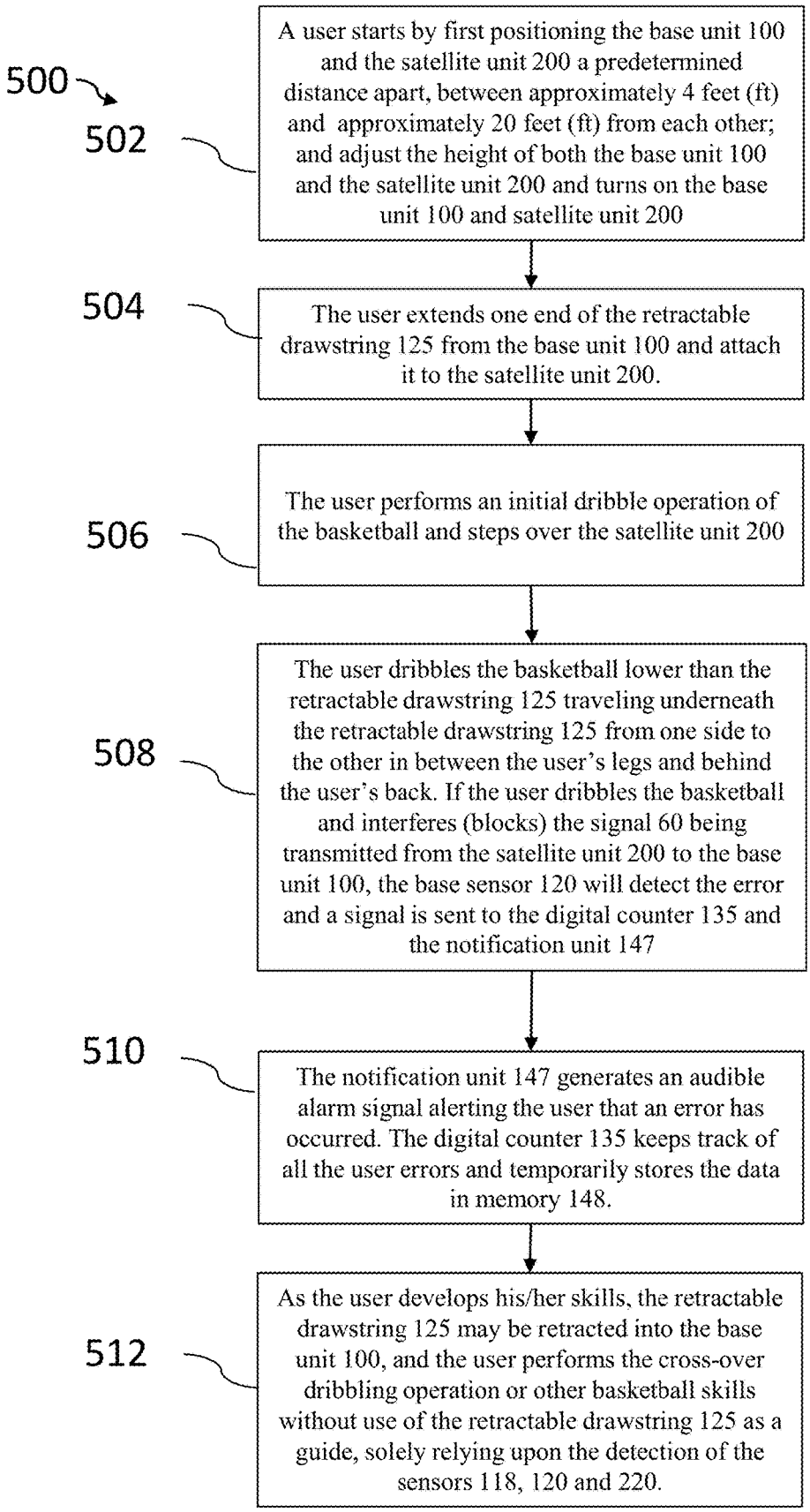
FIG. 5 is a flow diagram illustrating a method of performing a basketball skill (e.g., crossover dribble training) using the sensor-operated basketball training system shown in FIG. 1 according to one or more embodiments of the present invention.

Further operation of the system 50 within a method 500 will now be described with reference to FIG. 5. The method 500 begins at operation 502, where a user first positions the base unit 100 and the satellite unit 200 a predetermined distance apart, between approximately 4 feet (ft) and approximately 20 feet (ft) from each other; and adjust the height of both the base unit 100 and the satellite unit 200 to correspond to the height of the user's knee level for example, and to each other in order in order for the system 50 to operate properly. For example, the user may position the base unit 100 and the satellite unit 200 12 feet apart. Next, in operation 504, if desired the user extends one end of the retractable drawstring 125 from the base unit 100 and attaches it to the satellite unit 200. Alternatively, the user may elect to use the system 50 without use of the retractable string 125. The user then turns on the base unit 100 and the satellite unit 200 via an on/off switch of the respective power supply units 146 and 246. When the base unit 100 is turned on, the controller/processor 145 sends a timing signal to the timer 134 to start timing. When the satellite unit 200 is turned on, the controller/processor 245 sends a signal to the satellite sensor 220 to transmit the signal 60 to the receiver 121 at the base sensor 120 of the base unit 100.

Then, in operation 506, user performs an initial dribble operation of the basketball and steps over the satellite unit 200. Next, in operation 508, the user dribbles the basketball lower than the retractable drawstring 125 traveling underneath the retractable drawstring 125 from one side to the other in between the user's legs and behind the user's back. If the user dribbles the basketball interferences with the signal(s) 60 being transmitted from the transmitter 221 of the satellite sensor 220 of the satellite unit 200 to the receiver 121 of the base sensor 120 of the base unit 100, the base sensor 120 will detect the error at the receiver 121 and send a signal to the digital counter 135 and the notification unit 147. The user may dribble the basketball for 7 seconds, for example, and every time the user interferes with the signal 60 via the user's body or the basketball, the signal 60 is broken that was being transmitted from the satellite unit 200 to the base unit 100.

In operation 510, the notification unit 147 generates an audible alarm signal alerting the user that an error has occurred. The digital counter 135 keeps track of all the user errors and temporarily stores the data in memory 148. The timer will stop when the user comes into close proximity with the base proximity sensor 118.

Both the time data (e.g., 7 seconds) from the timer 134 and the count data (e.g., 3 errors) from the digital counter 135 are then displayed at the display 116 of the base unit 100, for the user to view.

According to another embodiment of the present invention, in operation 512, as the user develops his/her skills, the retractable drawstring 125 may be retracted into the base unit 100, and the user may operate the system 50 and perform the crossover dribbling operation or other basketball skills without use of the retractable drawstring 125 as a guide, solely relying upon the detection of the sensors 118, 120 and 220.

From operation 510 or 512, the user can use the remote control unit 160 (as depicted in FIGS. 4 and 6) to zero out the errors tracked, calculated by the digital counter 135 and start and stop the timer 134 and the digital counter 135 according to one or more embodiments of the present invention. The remote control unit 160 wirelessly communicates with the base unit 100 via wireless network 162, for example. For example, if the user needs to stop during operation of the system 50, the user presses the button on the remote control unit and the remote control unit 160 sends a signal to the controller/processor 145 to send instructions to the timer 134 and the digital counter 135 to stop. When the user presses the button again, the data on timer 134 and counter 135 are reset (i.e., zeroed out) and the timer 134 and counter 135 restart. According to other embodiments, the remote control unit 160 may wirelessly communicate directly with the timer 134 and/or the digital counter 135. The system 50 is also a portable system and the base portions 102 and 202 and leg portions 104 and 204 can be detached for carrying and storage purposes after use.

The sensor-operated basketball training system according to one or more embodiments of the present invention provides the advantages of allowing a user or player to monitor their speed and achieve efficient performance of the crossover dribble move, thereby enhancing their basketball skills.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

While the preferred embodiment to the invention had been described, it will be understood that those skilled in the art, both now and in the future, may make various improvements and enhancements which fall within the scope of the claims which follow. These claims should be construed to maintain the proper protection for the invention first described.

The invention claimed is:

1. A method for performing basketball training via a sensor-operated basketball training system to train a player or user, the system including a base unit having a base sensor including a receiver and a satellite unit having a satellite sensor including a transmitter, each providing upright support to the system on a flat surface and positioned a predetermined distance apart, the method comprising:

adjusting a leg portion of each of the base unit and the satellite unit in a vertical direction to correspond to a knee-height of the user;

supplying power, via power supply units, to the base unit and the satellite unit;

continuously transmitting an infrared signal from the transmitter of the satellite unit to the receiver of the base unit in a horizontal path aligned with the adjustable leg portions;

performing, by a user, a basketball operation comprising a crossover dribble beneath the signal path;

detecting, via the base sensor, an interruption in the infrared signal caused by the user or basketball;

generating, via a notification unit at the base unit, an alert to the user in response to the interruption;

counting, via a digital counter, a number of signal interruptions; and storing and displaying, via a memory and a display at the base unit, user-specific performance data associated with the basketball operation.

2. The method of claim 1, further comprising:

sensing, via a base proximity sensor at the base unit, when a user is within close proximity of the base unit during operation and automatically pausing counting of signal interruptions, and logging of the user-specific performance data during such proximity.

3. The method of claim 2, further comprising:

storing, via a memory at the base unit, the user-specific performance data; and displaying, via a display as the base unit, the user-specific performance data;

wherein the user-specific performance data includes error counts and session duration, and optionally user identity or training phase.

4. The method of claim 3, further comprising:

during the crossover dribble, dribbling, via the user, the basketball lower than the infrared signal being continuously transmitted and beneath the signal path from one side to another side in between the legs and back of the user, wherein the infrared signal is positioned at a predetermined dribble height, wherein when the user or the basketball interferes with the infrared signal, detecting, via the base sensor, an interruption of the infrared signal at the receiver and sending a signal via the controller to the digital counter and a signal to the notification unit to generate the notification alert to the user.

5. The method of claim 3, further comprising:

extending a retractable drawstring from the base unit to the satellite unit, in parallel with the infrared signal being transmitted to the base unit from the satellite unit, and during the crossover dribble, dribbling, via the user, the basketball lower than the retractable drawstring and beneath the signal path, traveling underneath the retractable drawstring from one side to another side in between the legs and back of the user, wherein when the user or the basketball interferes with the infrared signal, detecting, via the base sensor, an interruption of the infrared signal at the receiver and sending a signal via the controller to the digital counter and a signal to the notification unit to generate the notification alert the user, wherein the retractable drawstring serves as a reference threshold for evaluating dribble height and consistency.

* * * * *